United States Patent [19]

Muhs, Jr. et al.

[11] 4,429,313

[45] Jan. 31, 1984

[54] WAVEGUIDE SLOT ANTENNA

[76] Inventors: Harvey P. Muhs, Jr., 10331 Shirley Ave., Northridge, Calif. 91326; Charles K. Watson, 653 - 33rd St., Manhatten Beach, Calif. 90266

[21] Appl. No.: 324,590

[22] Filed: Nov. 24, 1981

[51] Int. Cl.[3] ..... H01Q 13/18

[52] U.S. Cl. ..... 343/771

[58] Field of Search ..... 343/770, 771

[56] References Cited

U.S. PATENT DOCUMENTS

| | | | |
|---|---|---|---|
| 2,573,746 | 11/1951 | Watson et al. | 343/771 |
| 3,125,731 | 3/1964 | Anderson | 343/771 |
| 3,500,251 | 3/1970 | Peace | 343/771 |
| 3,570,007 | 3/1971 | Whitehead | 343/771 |

*Primary Examiner*—Eli Lieberman
*Assistant Examiner*—Michael C. Wimer
*Attorney, Agent, or Firm*—Sanford Astor

[57] ABSTRACT

This invention relates to an arrangement of waveguide coupling mechanisms in a two-layer structure that will produce accurate excitation of the array radiating slot elements over a wide bandwidth, handle high input power and be useful either as a very small array or sub-array of a larger array.

6 Claims, 7 Drawing Figures

WAVEGUIDE SLOT ANTENNA

BACKGROUND OF THE INVENTION

Planar slot array antennas are well known in the art and generally include radiating slot apertures cut in the broad walls of several contiguous waveguides or waveguide cavities that form the aperture, and some means of distributing a radio frequency signal in such a way as to excite each radiating slot with the proper electric field to produce the desired farfield radiation pattern. On transmission, an RF signal couples from the input waveguide to the feed waveguide through the input slot. RF fields in the feed waveguide cavity couple in turn to the radiating waveguide cavities through inclined coupling slots in their common walls.

Inclined coupling slots are series elements in a feed waveguide transmission line, therefore, the feed waveguide must be terminated in a short circuit that transforms back to the plane of the last slot as a short circuit or small reactance. Consequently, the distance from the last coupling slot to the short circuit must be approximately one-half of a waveguide wavelength and would therefore extend beyond the desired physical limits of the array. To resolve this problem, a transverse series coupling slot is used to couple to another waveguide, a third layer, that is terminated in a short circuit at the appropriate position. This configuration is generally known as folded short.

It should be noted that the radiating slots are shunt elements in the radiating waveguide cavities; these elements must therefore be terminated by short circuits that transform back to the plane of the last waveguide as open circuits. Since the short circuits may then be placed one-fourth of a wavelength from the outer most radiating slots, the boundaries of the array need not extend beyond the desired dimension.

Because the boundaries of the slot array do not extend beyond one-half of a slot spacing from the last, or perimeter, slots in the array, these arrays (or sub-arrays) can be further arrayed to produce a much larger antenna. The individual sub-arrays can be fed by numerous methods, including corporate feed networks of waveguide or stripline power dividers.

There are two significant drawbacks to this prior art. First, the third layer of waveguide, increases the depth of the antenna by 50 percent, a serious drawback in many applications where space is limited, and increases the complexity of fabrication. Second, the minimum size of the array is limited; i.e., an array of four radiating slots cannot be built because the folded short will interfere with the input waveguide. A four slot array, or four slot sub-array of a larger array, is of particular importance because the line length from the input to any radiating element is the same, and the antenna is therefore essentially frequency independent to a first order. Another disadvantage of the large sub-arrays of the prior art is that some fraction of the radiating slots are in proximity to coupling slots; this proximity gives rise to coupling of energy that is not predicted by any practical first order mode theory, leading to errors in the array excitation of those radiating slots in proximity to coupling slots relative to the others not in proximity. These errors are particularly damaging when the arrays are used as sub-arrays in a larger array because the errors will repeat at periodic intervals equal to the sub-array spacing and lead to significant spurious grating lobes.

Another drawback of the prior art is that all of the input power to the subarray must pass through the narrow input slot. The high electrical field intensity in the slot is thereby a source of air-breakdown by ionization and significantly limits the power handling capability of the array.

It should be noted that the excitation errors leading to the spurious grating lobes become more pronounced as the height of the waveguide is reduced. Reduced height waveguide also diminishes the power handling capability of an array.

SUMMARY OF THE INVENTION

The general purpose of the invention is an arrangement of waveguide coupling mechanisms in a two-layer structure that will produce accurate excitation of the array radiating slot elements over a wide bandwidth, handle high input power, and be useful as a very small array or sub-array of a larger array.

It is an object of the present invention to produce a waveguide coupling mechanism constructed entirely of waveguides in two contiguous layers sharing their broad walls, which can be fabricated of reduced height waveguide to further reduce the thickness of the array.

A further object is to produce a waveguide circuit which contains no dielectric materials or dissipative loads and is therefore capable of achieving the efficiencies of standing-wave arrays.

BRIEF DESCRIPTION OF THE DRAWINGS

Referring to FIGS. 1 and 2, there is shown a waveguide coupling mechanism 10. RF power is coupled to the device through the input waveguide 12 to the feed waveguide 14. A common wall 15 exists between the upper layer comprising the input waveguide 12 and the feed waveguide 14 and the lower layer comprising the radiating waveguide 16. Inductive irises 17 and 18 and an inductive septum 20 are used to produce impedence match of the input waveguide to the feed waveguide 14 over a broad frequency band. Power is coupled from the feed waveguide 14 to the radiating waveguide 16 through two coupling slots 22 and 24 cut in their common wall 15. The coupling slots 22 and 24 are parallel to the axis of the feed waveguide 14 and are therefore a shunt element in the feed waveguide. A short circuit 26 is therefore placed at either end of the feed waveguide 14, one-quarter of a waveguide wavelength from the center of the adjacent slot, 24.

Figure 1:
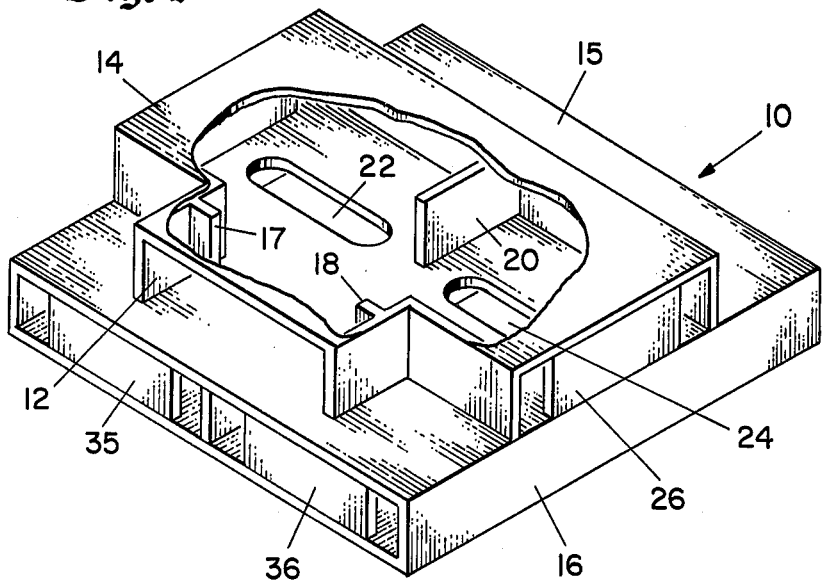
FIG. 1 is a perspective view from the back of the invention.
Figure 2:
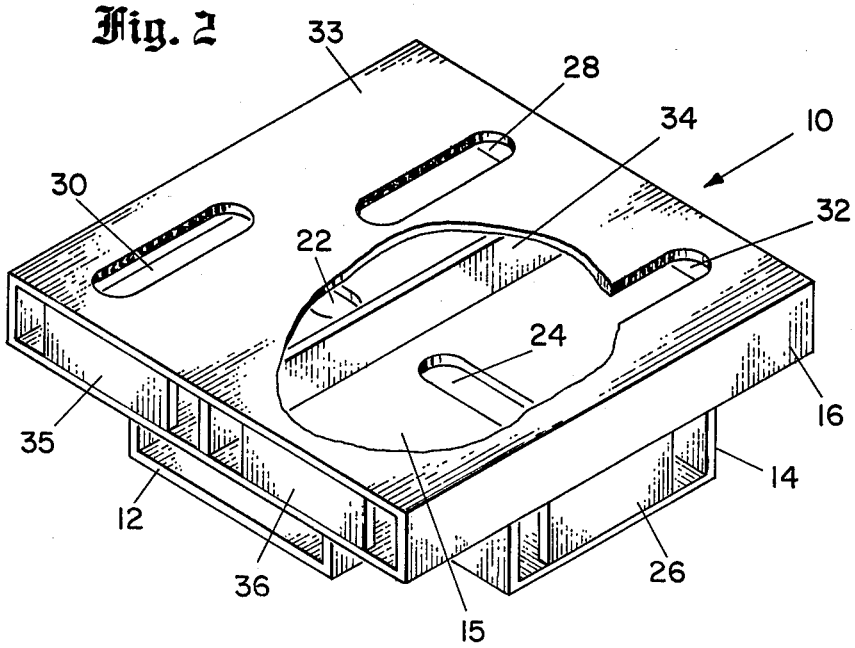
FIG. 2 is a perspective view from the front of the invention.

The coupling slot 24 is transverse to the radiating waveguide 16; therefore it is a series element in the radiating waveguide, i.e., it delivers anti-phase signals in either direction. The signals are radiated by a plurality of longitudinal (shunt element) radiating slots 28, 30, and 32 cut in the radiating waveguide face sheet 33.

The radiating waveguide 16 is divided into two adjacent radiating waveguide cavities formed by a divider 34 in the radiating waveguide 16. The two slots in each waveguide are offset in opposite directions from the radiating waveguide centerline so that inphase radiation is accomplished. Alternatively, the radiating slots 28, 30, and 32 may be centered in the broad wall of the waveguide cavities, in which case, internal elements such as irises or posts must be used to excite the slots in the appropriate manner.

Short circuits 35 and 36 are placed at the ends of each radiating waveguide cavity and similar short circuits are provided at the opposite ends, not shown.

Figure 3:
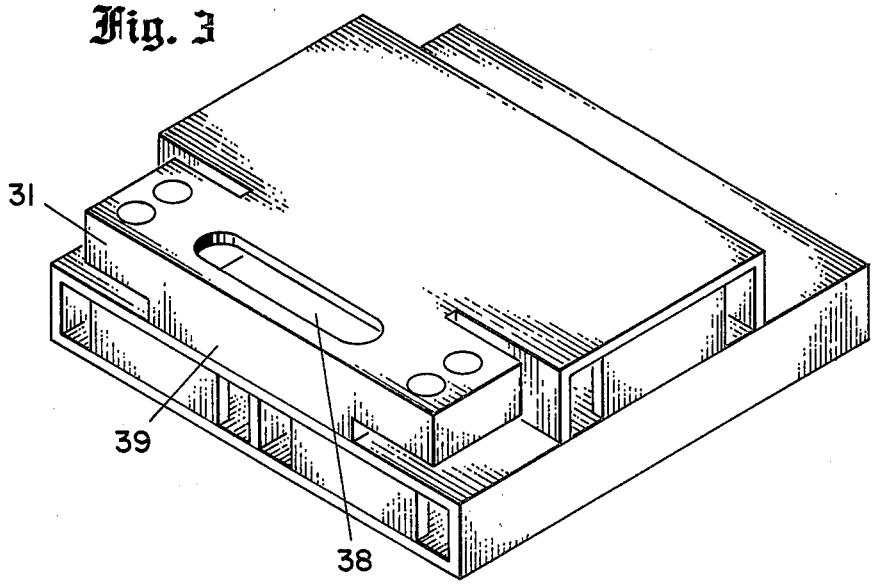
FIG. 3 is a perspective view showing a waveguide input.
Figure 4:
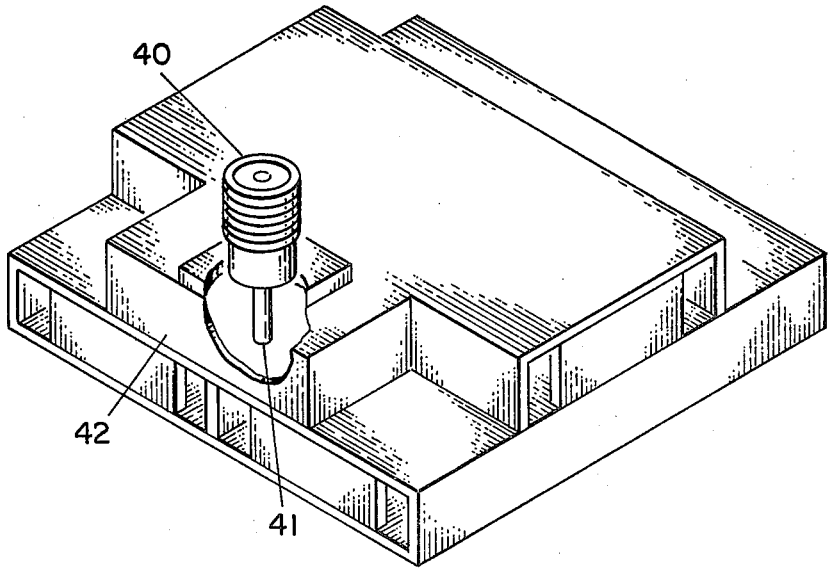
FIG. 4 is a perspective view showing a coaxial input.

The invention can be used in conjunction with different input transitions. Waveguide and coaxial inputs are shown in FIGS. 3 and 4, respectively. The waveguide input (FIG. 3) consists of a flange 37, coupling slot or waveguide aperture 38 and short circuit 39. The coaxial input, FIG. 4, consists of a coaxial connector 40, E-field probe 41, and short circuit 42.

Figure 5:
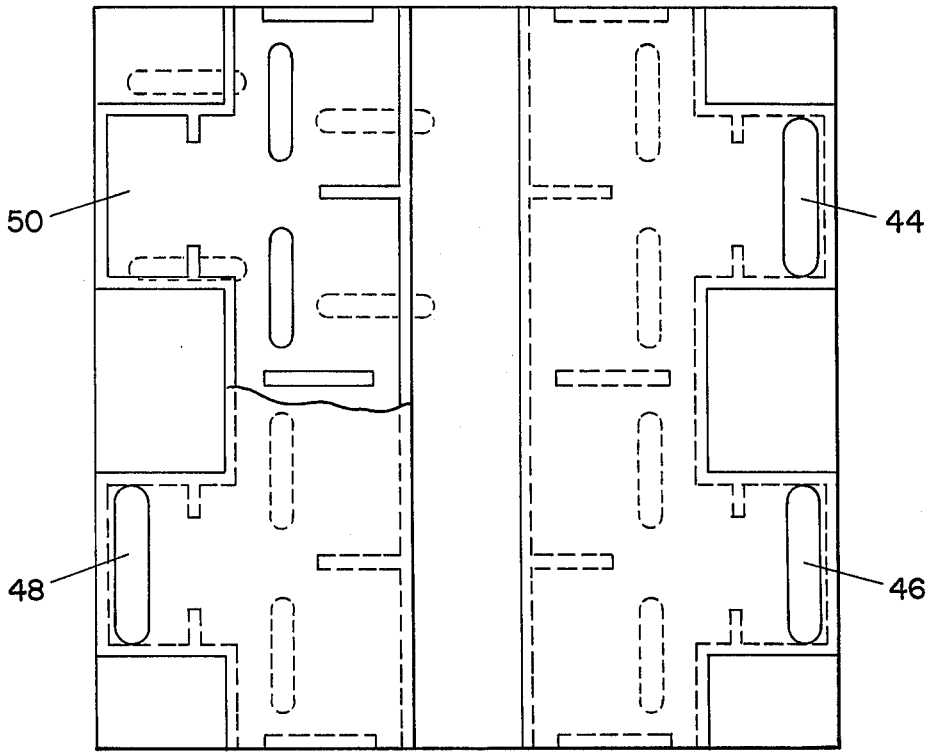
FIG. 5 is a diagrammatic view of the invention as a quadrant sub-array of a larger array.
Figure 7:
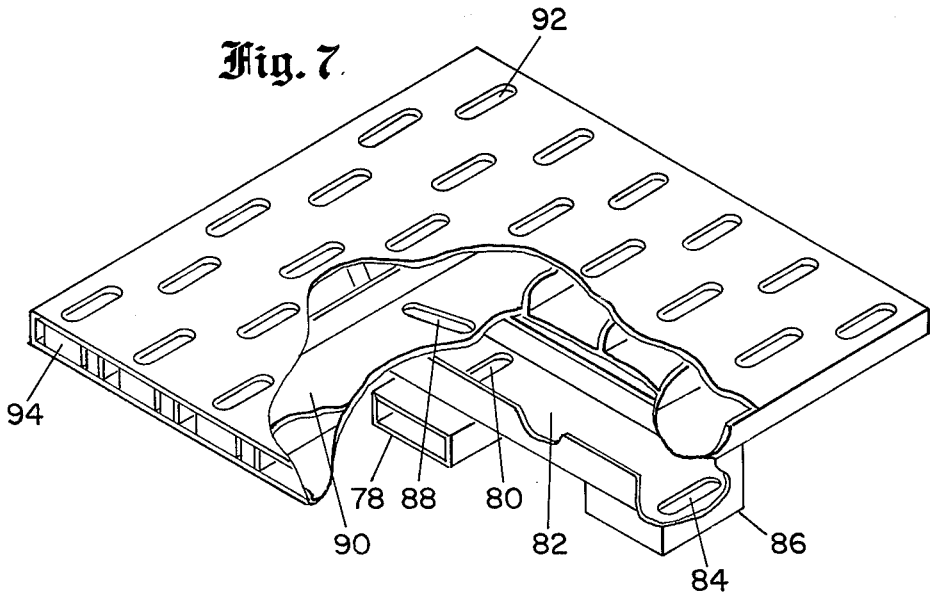
FIG. 7 is a perspective view of a standing wave array of the prior art.

FIG. 5 illustrates the invention when used as a sub-array of a larger antenna comprised of 4 sub-sections. The four inputs 44, 46, 48 and 50, can be combined with a stripline or waveguide power divider network or a monopulse comparator to form a full antenna. These sub-arrays can be repeated as desired to form an array of any practical size.

Figure 6:
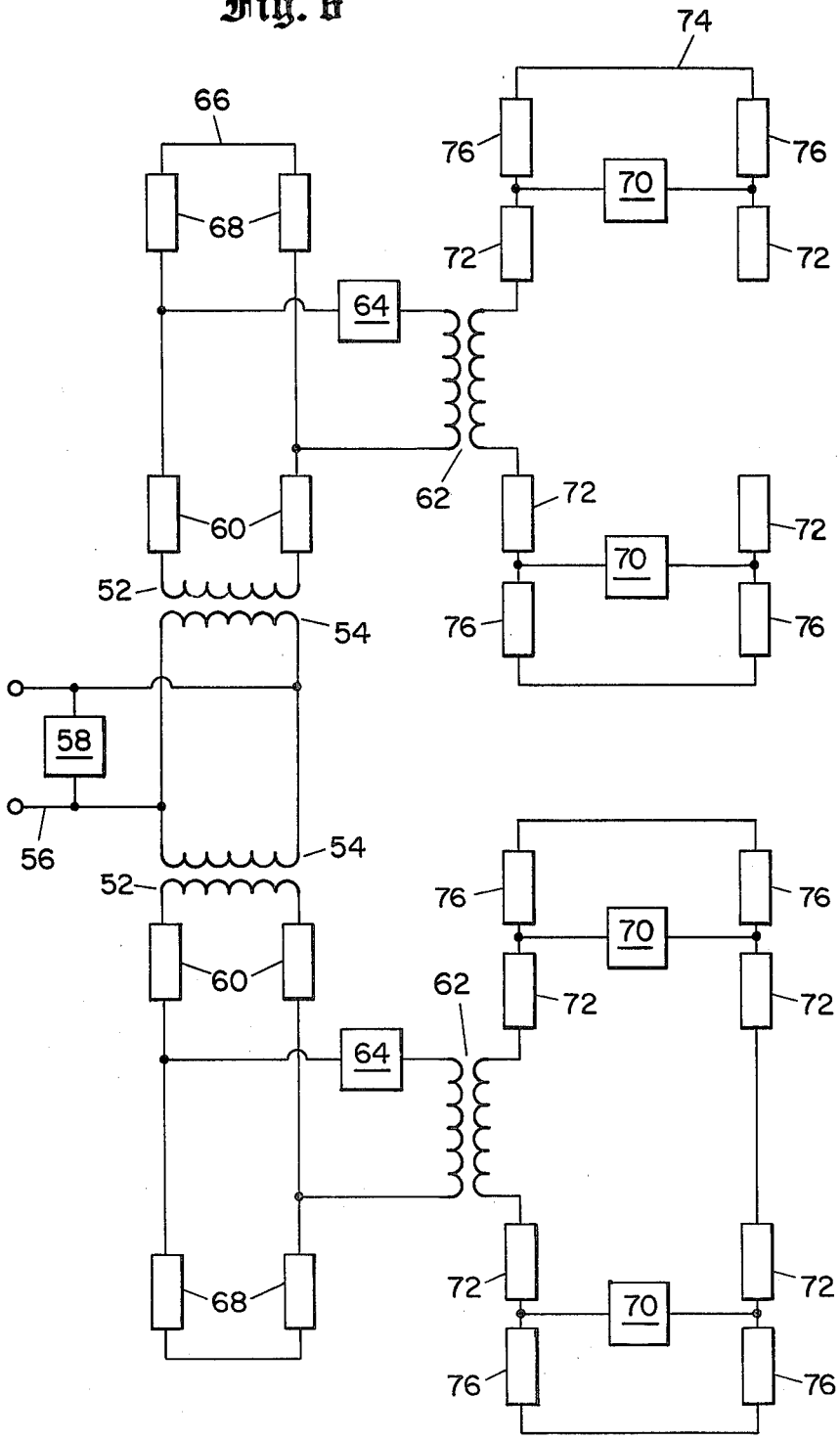
FIG. 6 is a circuit diagram of the invention.

The equivalent circuit of the basic invention is shown in FIG. 6. The input waveguide junction to the feed waveguide is represented as a pair of transformers, 52 and 54, coupled in shunt to a common input line 56. A shunt susceptance element 58 represents the total junction susceptance. An important property is shown herein; namely, that the signals coupled to either side of the input are in phase, independent of the transformer turns ratios. A transmission line of electrical length 60 separates the input junction centerline from the adjacent coupling slot which is represented by a shunt-series transformer 62 and slot reactance 64. The feed waveguide is terminated at either end by a short circuit 66, separated from the adjacent coupling slot by a length of transmission line 68.

Within the radiating waveguide, the radiating slot is represented by a complex admittance 70 separated from the coupling slot by a length of transmission line 72 and from the short circuit 74 by a length of transmission line 76.

Several important properties of the invention are illustrated by the equivalent circuit. The line length from the input to any output (radiating slot 70) is identical (viz, 60, 68, 72, 76), therefore all radiating elements are driven in-phase to form a focused beam. The relative values of the transformer turns ratios 52 and 54 and the radiating slot admittances 70 can be selected to achieve any desired distribution of power to the radiating elements. The slot element admittances are controlled by the offset of the slot from the waveguide centerline and the slot length. The transformer ratios are controlled by the offset of the input waveguide from the array centerline. The transformers 62 are shunt elements in the feed waveguide and the radiating elements 70 are shunt elements in the radiating waveguide; hence, the short circuits 66 and 74 are separated from their adjacent slot elements 62 and 70 by one-quarter wavelength transmission lines 68 and 76 to form open circuits at the slot elements.

FIG. 5 shows a perspective view of a typical prior art standing wave array or sub-array. Shown is the input waveguide 78, the input coupling slot 80 and the feed waveguide cavity 82 with its folded short that includes a transverse coupling slot 84 and secondary waveguide section 86. The inclined coupling slots 88 couple energy from the feed waveguide cavity 82 to the radiating cavities 90 which contain the shunt slots 92 that radiate the energy in the desired manner. The radiating slots 92 are shunt elements so the short circuit terminations 94 in radiating cavities are located one-quarter of a waveguide wavelength from the outer most radiating slots 92.

The invention has the property that the radio frequency path length from the input to any radiating slot element is indentical by symmetry and as will be described. The invention is reciprocal, therefore this and other properties apply equally to transmission and reception.

The property of equal path length leads to several benefits, heretofore unknown. First, the relative excitations of the array elements are independent of frequency, to a first order, over the waveguide bandwidth. Thus, the radiation pattern bahavior is also frequency independent. Second, the frequency bandwidth over which the antenna input impedance is matched to the generator is much broader than with prior known arrays. Third, the instantaneous bandwidth is significantly greater than known arrays and the transfer phase of the antenna is essentially linear with frequency, leading to the property that very short pulses or widebank signals can be transmitted or received without distortion.

Another benefit of the invention is that it reduces the amount of near field coupling between the radiating slots and the coupling slots caused by the interaction of higher order (evanescent) modes that is characteristic of prior known arrays.It does so by the elimination of a need for inclined (angled) slots that (1) excite a larger number of evanescent modes and (2) extend within the radiating waveguide to the degree that they overlap the adjacent radiating elements. Furthermore, since each radiating element is in identical juxtaposition to its coupling slot, any residual evanescent mode coupling is the same for all radiating elements. Thus, the radiation pattern behavior determined by relative array excitations is not degraded by errors arising from evanescent mode coupling, and when used as a sub-array in a larger array, undesirable grating lobes are eliminated.

The equal radio frequency path length from the input to each radiating slot element applies to the invention in its most effective electrical configuration. The two-layer structure does not limit the invention to four radiating elements but rather to two parallel waveguide cavities containing the radiating elements. The two parallel waveguide cavities may each contain more than two radiating elements and the number in each cavity need not be equal. In such a configuration the only aspect of the invention that does not apply is the one pertaining to equal path length. In many applications this somewhat less effective electrical configuration would provide adequate performance yet maintain the advantageous two-layer structure.

Another benefit is that the invention will handle more RF power than prior known arrays. The input waveguide is connected to the feed waveguide by a large opening in the narrow wall of the feed waveguide. Consequently, the maximum electric field intensity in the array is substantially reduced relative to the prior art array in which all power passes through a single narrow slot. When the invention is used as a sub-array of a larger antenna, it represents a smaller portion of the aperture, as compared to prior art, since it contains fewer radiating elements. This implies that the invention would have a lower power level at the input since the power to each sub-array is, in general, proportional to the number of radiating slots contained therein. Thus a given sized aperture could be utilized at a higher power level when the basic invention is the sub-array unit.

The input to the array can be waveguide, coaxial, stripline or any other suitable transmission line. The waveguide input and coaxial input as shown in FIGS. *2a* and *2b*, respectively, can fit entirely within the depth of the two-layer structure, or as is more common, can come from the back of the array such as the coaxial input of FIG. *2b*. The antenna can be matched to a 50 ohm input impedance or other suitable impedances can be achieved.

When used in conjunction with a suitable feed system the invention can be used as a sub-array of a larger array. The sub-arrays can be positioned contiguously in such a way that there are no gaps between them and there is a continuous lattice spacing between slots. In this manner, radiation pattern deterioration and grating lobes caused by an interrupted element spacing are averted. This property of the invention is made possible because the radiating and coupling slots are shunt elements in their respective waveguides, and the waveguides can therefore be terminated by a short circuit that is one-quarter of a guide wavelength (or equivalently, one-half of a slot spacing) from the nearest slot.

If the RF system used to feed the individual sub-arrays consists of equal path lengths from the input to each output (or sub-array input), then the benefits set forth regarding the bandwidth of the basic invention still apply to the total antenna. Among the types of feeds that fall in this category are corporate feeds, series feeds and lens feeds. The feeds can be rectangular, parallel plate or other waveguide; stripline, coaxial or other TEM transmission lines; and can be coupled to the sub-arrays by any of the means previously described.

A further benefit of this invention is that the relative excitation amplitude of slots within the array can be controlled through a proper selection of certain parameters while maintaining equal phase. In so doing, the radiation pattern of the antenna can be controlled; when the array is used as a sub-array of a larger array, the field distribution acrosss the aperture can be tapered to produce low side-lobes or shaped sector beams. By displacing the input waveguide from the centerline of the array or sub-array, more energy is delivered to the coupling slot on the side toward which the input waveguide is displaced. A unique feature of the design is that equal excitation phase is maintained for a large range of power divisions. After energy has coupled to the radiating waveguides, it is distributed to each slot within a radiating waveguide in accordance with their relative conductance, viz., $P_2/P_1=G_2/G_1$. Again, equal phase is maintained, provided that the slots are made to be resonant (B=O) at the same frequency.

Having described the invention, it is desired that it be limited only by the scope of the appended claims.

We claim:

1. A two layer waveguide coupling mechanism having a common wall between the layers and a radiating aperture, the first layer comprising an input waveguide, a feed waveguide whose structure does not extend past the boundary of the radiating aperture, a short circuit at either end of the feed waveguide, coupling slots in the common wall between the layers, the second layer comprising two adjacent radiating waveguide cavities, a short circuit at either end of each cavity, and radiating slots in the radiating aperture.

2. The device of claim 1 comprising an inductive septum in the first layer adapted to provide impedance match of the input waveguide to the feed waveguide.

3. The device of claim 2 comprising inductive irises in the input waveguide to provide additional impedance matching.

4. The device of claim 1 comprising an input waveguide that is offset from the centerline of the radiating aperture to provide the desired distribution of power to the individual radiating waveguides.

5. The device of claim 1 wherein the input is a coaxial input.

6. The device of claim 1 wherein a plurality of waveguide coupling mechanisms are combined to form a larger antenna.

* * * * *